US006082385A

United States Patent [19]

Burford et al.

[11] Patent Number: 6,082,385

[45] Date of Patent: Jul. 4, 2000

[54] SUPPORTING TRUSS, FOR EXAMPLE A SHELTER STRUCTURE

[75] Inventors: Neil Keith Burford, Broughty Ferry; Fraser William Smith, Tealing; Daniel Cecil Edward Fish, New Milton, all of United Kingdom

[73] Assignee: Web Engineering & Fabric Technology Limited, Dundee, United Kingdom

[21] Appl. No.: 09/011,950

[22] PCT Filed: Aug. 23, 1996

[86] PCT No.: PCT/GB96/02062

§ 371 Date: Sep. 8, 1998

§ 102(e) Date: Sep. 8, 1998

[87] PCT Pub. No.: WO97/08411

PCT Pub. Date: Mar. 6, 1997

[30] Foreign Application Priority Data

Aug. 25, 1995 [GB] United Kingdom ..... 9517500

[51] Int. Cl.[7] ..... E04H 15/40

[52] U.S. Cl. ..... 135/104; 135/116; 135/119; 52/64

[58] Field of Search ..... 135/97, 107, 112, 135/104, 116, 119; 52/64, 86

[56] References Cited

U.S. PATENT DOCUMENTS 3,473,272 10/1969 Hasselquist .
4,325,207 4/1982 Russell ..... 52/641
4,649,947 3/1987 Tury ..... 135/97
4,665,935 5/1987 Nichols .
5,116,273 5/1992 Chan .

FOREIGN PATENT DOCUMENTS 1 116 883 1/1982 Canada .
0 007 580 2/1980 European Pat. Off. .
2 171 318 9/1973 France .
2 189 594 1/1974 France .
2 094 367 9/1982 United Kingdom .

*Primary Examiner*—Beth A. Stephan
*Attorney, Agent, or Firm*—Christensen O'Connor Johnson & Kindness PLLC

[57] ABSTRACT

A structural supporting truss (12) comprises an elongate rib (14) of resilient material connected to a web (16) of fabric material. The rib (14), in use, is elastically deformed to adopt a curved shape. The web (16) extends radially inwardly of the rib (14) along its length, the web (16) acting in tension to retain the rib (14) in its curved condition. The rib (14) may be made of a plurality of segments interconnected by hinges. The web (16) may comprise a plurality of panels (20). The rib (14) is subject to a compressive force. A remarkably stiff truss structure is formed such as may be used as a supporting truss for a tent of like shelter structure.

27 Claims, 10 Drawing Sheets

SUPPORTING TRUSS, FOR EXAMPLE A SHELTER STRUCTURE

This is a United States national application corresponding to copending international application PCT/GB96/02062 filed Aug. 23, 1996 which designates the United States, the benefit of the filing date of which is hereby claimed under 35 U.S.C. § 120, which in turn claims the benefit of British applicaton No. 9517500.6 filed Aug. 25, 1995, the benefit of the filing date of which is hereby claimed under 35 U.S.C. 119.

The present invention relates to a supporting truss which may be used, for example, in a fabric shelter structure. The range of such structures to which the invention may relate is very broad, potentially including structures as diverse as a one-person tent, and a large shelter for housing or repairing motor vehicles and aircraft and/or many tens of people. The truss also has potential applicability in other circumstances where a lightweight supporting truss is required.

Various shelter structures have been well-known for some considerable time. As an example of such a structure there is traditional demountable tent comprising a rigid structural frame, supporting a loose membrane or a stressed, double-curved membrane of fabric material.

A tent structure developed more recently, most particularly for use in small tents, comprises a structural support frame of members (usually tubular high tensile metal alloy, or reinforced or unreinforced plastics) supporting a membrane of textile material. The structural framework is attached to the membrane throught sleeves or at discrete hanging points. The membrane variously support the membrane as single members and as components of a framework of geodesic form. Typically, the members naturally are straight, being bent elastically, forced into place, and restrained by attachment points of a groudsheet. That the members are naturally straight reduced packed bulk and weight of the tent. Furthermore, the geodesic form of the erected tent gives good strength and useful internal space. This type of structure will be referred to as a "sprung tent".

Such sprung tents have become popular for use in tents intended for occupation by a relatively few individuals. However there are relatively few examples of medium to large scale uses of this type of construction. The sprung tent is limited in size and scale due to the stiffness of the supporting structure. The frame needs to be flexible enough to be sprung into position, yet stiff enough to resist applied loads and limit excessive deflections caused thereby. An example of such a tent is disclosed in GB-A-2094367.

Support trusses of span larger than readily possible in a sprung tent have been created with post tensioning systems utilising lightweight members with an arrangement of compression struts and wires. Although these structures are lightweight, their joining and mechanical parts are complex, this preventing ease of erection and dismantling. An example of such a structure is disclosed in FR-A-2171318.

U.S. Pat. No. 3,473,272 discloses a spherical structure in which a flexible web is supported by a plurality of stressed rib elements in which a flexible pile is held in a curved condition by a fabric sleeve and a tensioning rope.

It is an aim of the present invention to provide a supporting truss which may be used with a shelter structure to permit the construction of strong, lightweight and simple shelters of all sizes.

According to a first aspect of the invention there is provided a structural supporting truss comprising an elongate rib (14) of resilient material and a web (16) of fabric material; in which truss:

the rib (14) is connected to the web (16); and the rib (14), in use, is resiliently deformed to adopt a curved shape, the web (16) extending radially inwardly of the rib (14) along its length, such that the web (16) acts in tension to retain the rib (14) in its curved condition, characterised in that the web (16) comprises a plurality of interconnected fabric panels (20);

and in that the shape of the panels (20) is such that, when interconnected and laid flat, the web (16) adopts approximately its shape in the assembled truss.

It has been found that this arrangement produces a truss of remarkable stiffness, without compromise to simplicity or lightness. It is believed that the benefit arises because the rib is maintained in compression, while the web is loaded in tension, to form a composite structure the components of which mutually reinforce one another.

Models have been made embodying the invention using different materials for both the web and the rib, as well as alternative fixings and means for tensioning which have established the efficacy of the present invention. Results of tests show a substantial increase in strength and rigidity of the structure embodying the invention as compared with a similar structure supported by a rib only.

In order to gain full advantage of the invention, it has been found to be preferable that the fabric of the web is capable of resisting shear stresses. The amount of such resistance has not yet been determined by the inventors, but it has been found to be readily ascertained by experiment.

Particularly favourable properties have been found to be provided if the material of the web is bias cut woven material. That is to say, its warp and weft fibres are both disposed diagonally to the extent of the rib. Most preferably, both warp and fill fibres are disposed at an angle of approximately 45° to the rib.

According to a second of its aspects, the invention provides a shelter structure comprising a frame including at least one truss embodying the first aspect of the invention and an outer membrane supported by the frame.

The outer membrane is typically made of a weather resistant fabric material.

The outer membrane may be simply draped over the frame, or it may be bolted or otherwise fixed to the trusses. Most preferably, the outer membrane may be slidingly attached to the truss, for example by providing a Keder edge or a beaded edge on fabric components of the membrane for retention in a suitable groove in the rib of the truss.

An embodiment of the invention will now be described in detail, by way of example, with reference to the accompanying drawings in which.

With reference to FIGS. 1 to 4, a shelter embodying the invention takes the form of a large tent, approximately 8 m to 10 m in length.

The tent comprises a weatherproof outer fabric membrane formed from a multiplicity of fabric sections 10. The fabric sections 10 are supported by and interconnected by a plurality of trusses 12.

Figure 2:
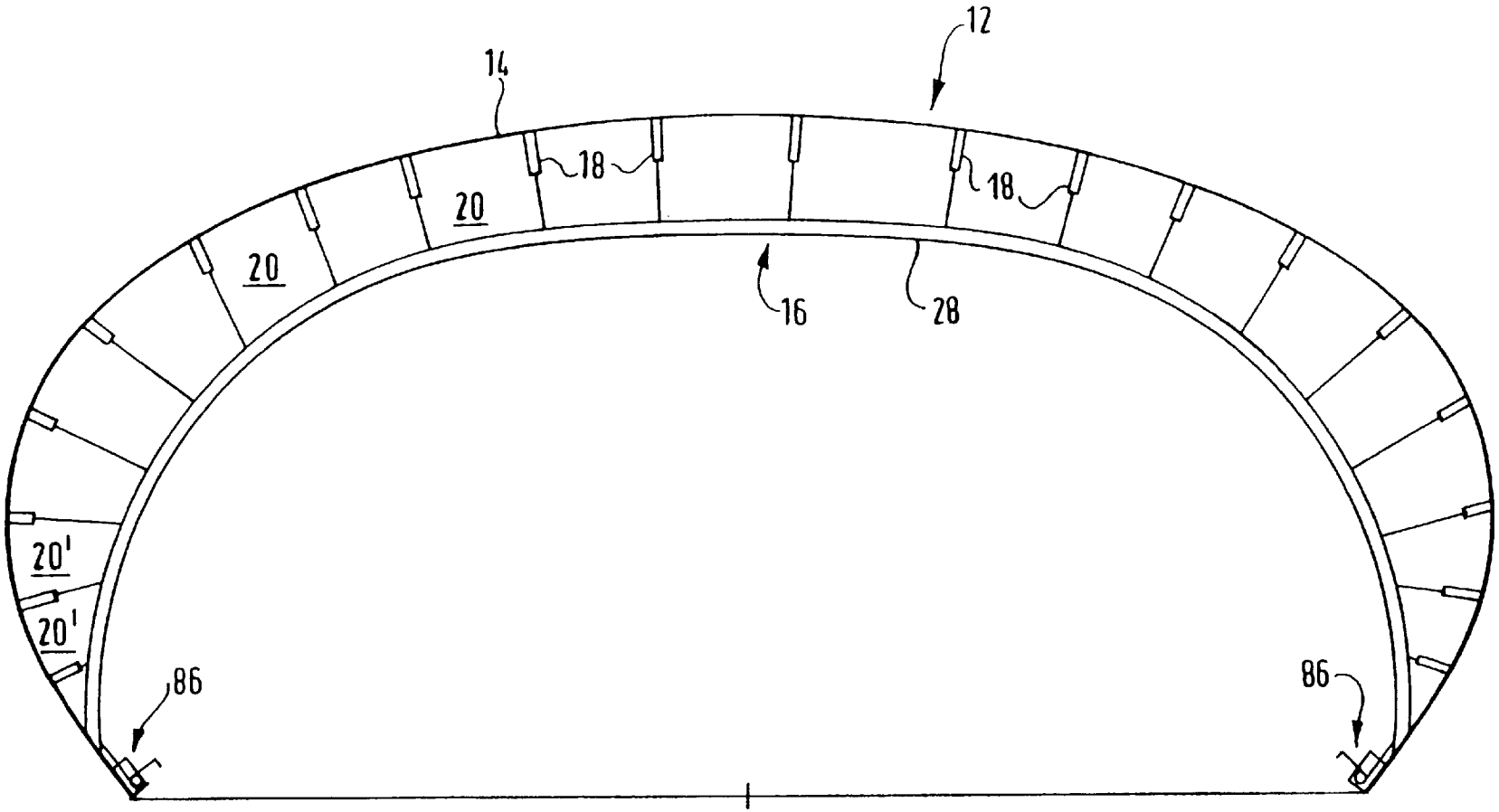
FIG. 2 is a side view of a supporting truss embodying the invention, and being a part of the shelter of FIG. 1.
Figure 3:
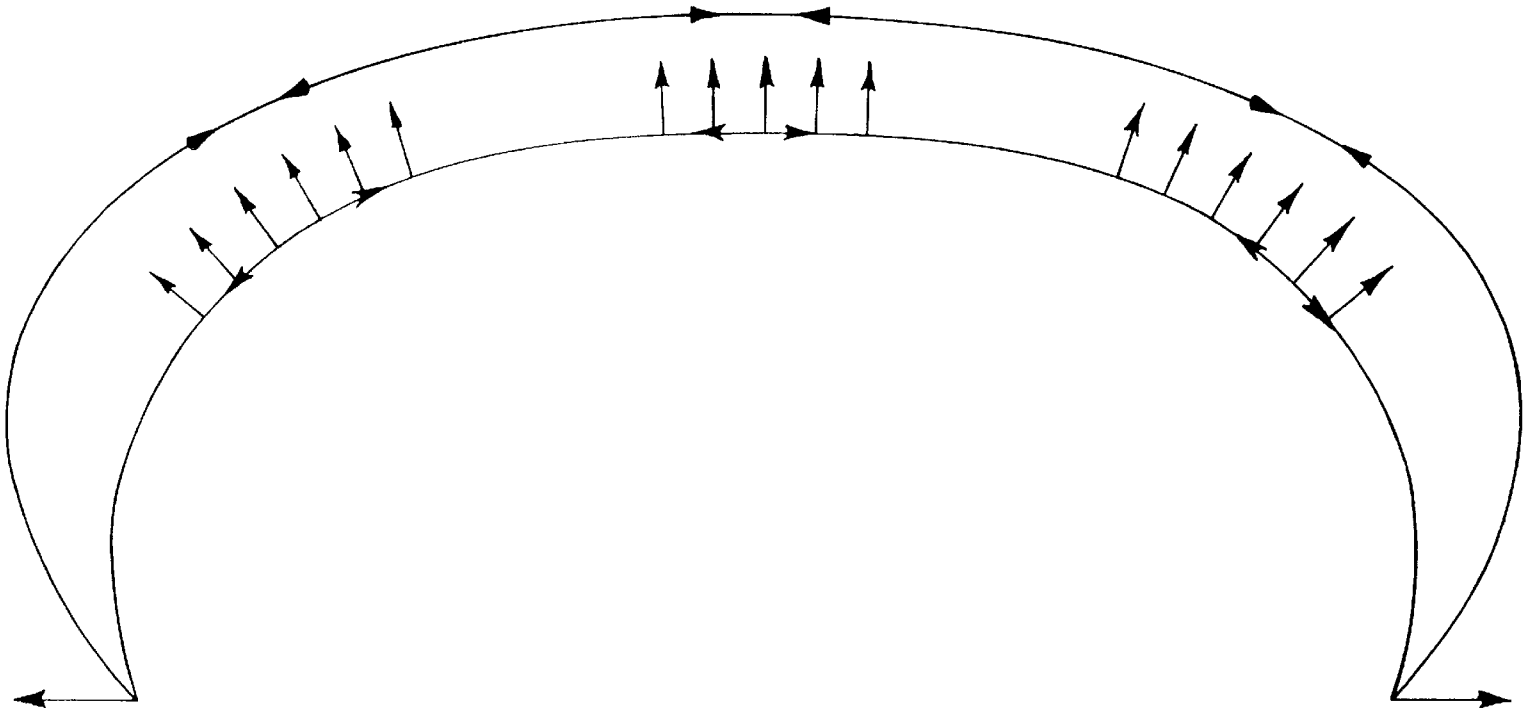
FIG. 3 is a diagram of forces within the truss of FIG. 2.

As can be seen from FIG. 2, each truss 12 comprises a rib 14 which, in an assembled condition (as shown in the figures) is elastically deformed into a curved shape, such that end portions of the rib are axially convergent. A web 16 of fabric material is secured to the rib 14, inwardly of it and in the plane of its curve. The web 16 is secured by connecting elements 18 spaced along the length of the rib. The connecting elements are free to slide along the rib 14, but cannot be pulled away from it. The truss 12 is maintained in a stable curved condition by securing end portions of the web 16 to proximal respective end portions of the rib 14, tension in the web 16 resisting the resilient urge of the rib 14 to spring straight.

Figure 4:
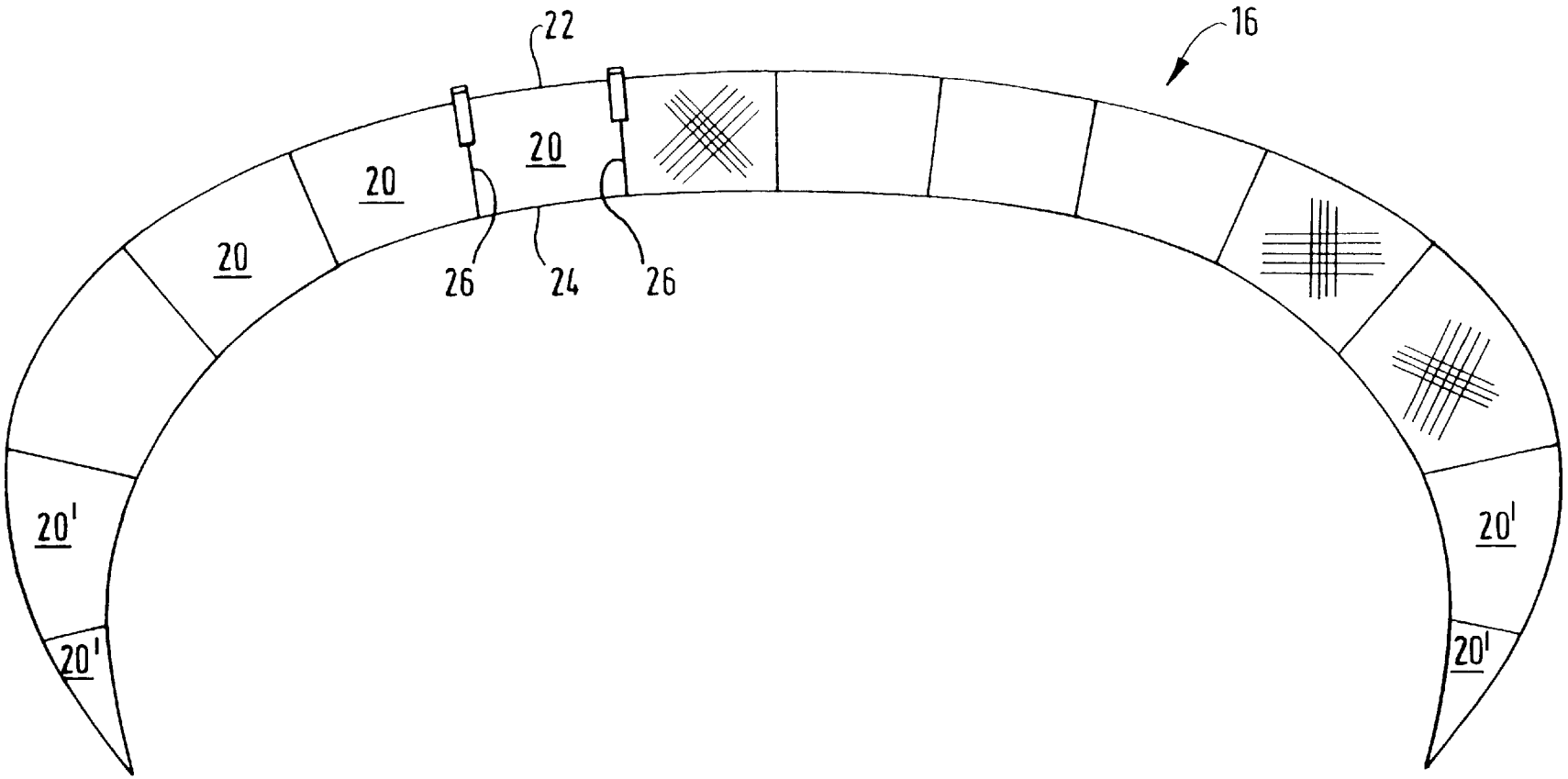
FIG. 4 shows diagrammatically the disposition of fabric within the truss.

As is shown best in FIGS. 2 and 4, the web 16 comprises a plurality of fabric panels 20. Each panel 20 is shaped individually to have an outer edge 22 which, in the assembled truss 12 lies adjacent the rib 14, an inner edge 24 which lies remote from the rib 14, and two side edges 26 which are disposed substantially radially of the rib 14. Adjacent panels 20 are interconnected by sewing or by other additional or alternative means at their side edges 26. The shape of the panels 20 is such that, when interconnected and laid flat, the web 16 adopts approximately its shape in the assembled truss.

The panels 20 are each made of a woven fabric material. An inelastic material of good shear stiffness such as a tightly woven and heat shrunk polyester sail cloth has been found to be suitable. However, for large structures, a higher strength fabric such as Kevlar or Dyneema may be preferable. The relationship between the stiffness of the material and the stiffness of the truss may be determined by experiment. The panels are formed such that, in the assembled truss 12, the threads in the warp and the fill directions (shown in FIG. 4) are neither parallel nor perpendicular to the axis of the rib 14, but are at an angle in the region of 45°.

At each end region of the web 16, there is provided a plurality of panels 20' which taper in their radial dimension, such that the depth of the web 16 is reduced at its end portions.

Along its inner edge, the web 16 is provided with a flexible tensile member 28, continuously secured to the panels 20 adjacent their inner edges 24. The tensile member 28 may be formed from a length of webbing sewn along the inner edges 24 of the panels 20. Alternatively or additionally, a cord or a cable may be secured within the webbing. In such arrangements, the cord or cable, as the case may be, is preferably secured against movement along the web, although simply threading it within the web may work if frictional forces are sufficient to hold it in position.

Each connecting element 18 comprises a length of webbing sewn to the web 16 to overlie an outer portion of the seam between two adjacent panels 20, and to form a loop disposed adjacent the web 16. Within the loop, there is a bead of semi-flexible plastics material to form a bulbous end portion which engages within a cooperating formation 38 in the rib 14, as will be described below.

Figure 5:
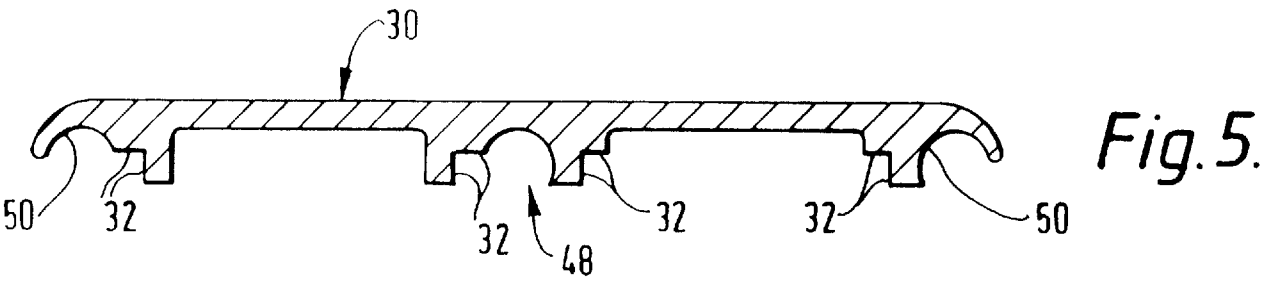
FIG. 5 is a section of an element from which a preferred form of rib for use in the invention is constructed.
Figure 6:
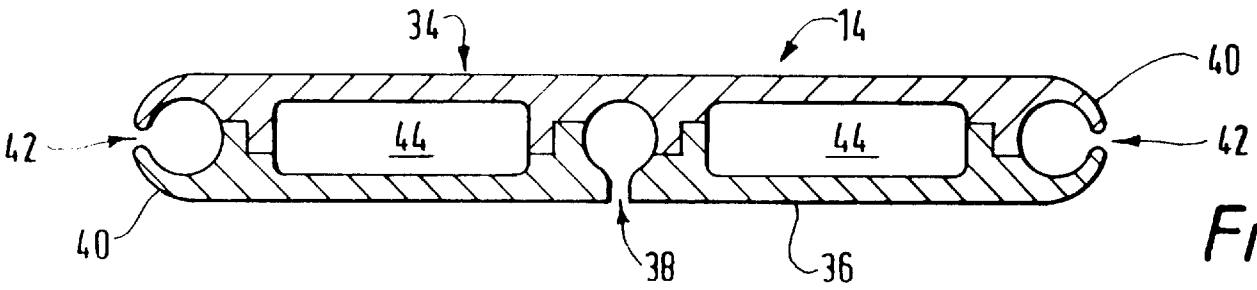
FIG. 6 is a section of a rib constructed from elements as shown in FIG. 5.
Figure 7:
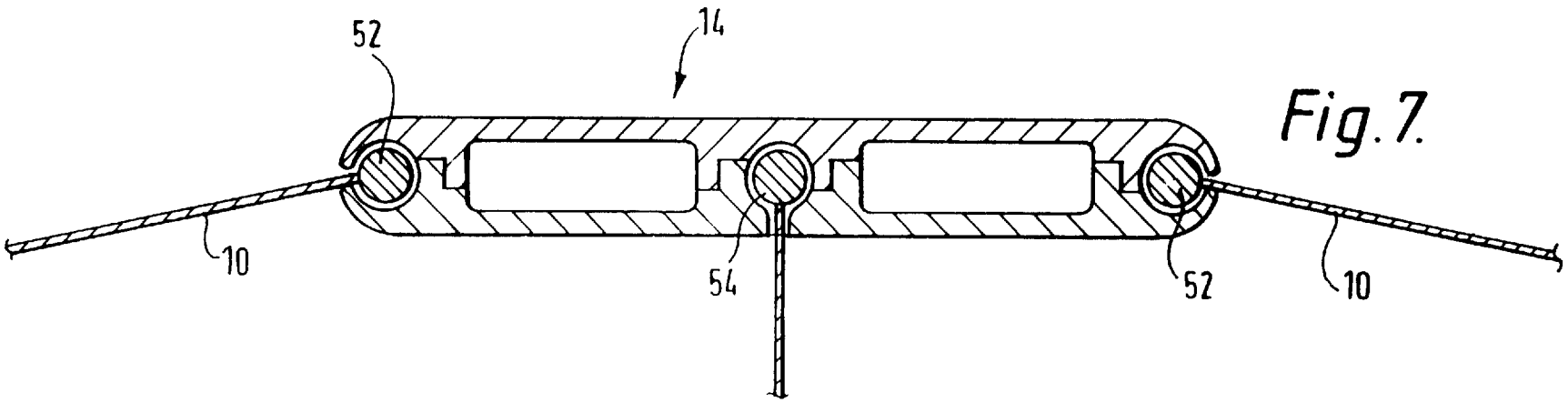
FIG. 7 shows in section the rib of FIG. 6 in use in a shelter.

With reference to FIGS. 5 to 7, the rib 14 will now be described in detail.

The rib 14 is made of a material which enables it to be bent resiliently to the desired shape, without failing nor acquiring a permanent set into the curved shape. Such materials include metal tubing, glass-fibre or carbon-fibre reinforced plastic, or any other suitable thermosetting or thermoplastic reinforced material, or wood or other similar materials.

In this embodiment, the rib 14 is assembled from two identical elements 30, the section of which is illustrated in FIG. 5. The elements 30 are formed as extrusions or pultrusions of fibre reinforced plastics. These elements are formed into a rib 14 having a section shown in FIG. 6, by securing two lengths of the element 30 together in a face-to-face disposition. The element 30 is provided with mutually interengagable abutment faces 32 at which an adhesive bond can be formed between two elements 30.

It will be appreciated that the rib could readily be of many varied forms within the scope of the invention. A rib similar to that of the present embodiment could be made as a single extrusion or pultrustion. Alternatively, it could be assembled from three extrusions or pultrustions, one for the outer surface and two for the inner, these together forming the groove 42 to avoid the need to machine it. This might increase the strength of the groove walls and also increase its smoothness, the latter having the advantage of reducing wear on the attachment members 18 of the web 14 as they slide within it.

The assembled rib 16 has a flat outer surface 34, a generally flat inner surface 36 in which is formed a longitudinal groove 38, to be described below, and curved side surfaces 40 into each of which a groove 42 is formed, also to be described below. Within the rib 16 two longitudinal voids 44 are formed.

The groove 38 in the inner surface has a relatively narrow, parallel-sided opening, and broadens into a generally circular shape within the rib 14. The groove 38 is formed by providing within each element 30 a central semi-circular recess 48 to form a longitudinal, circular void when two elements 30 are interconnected. Then, following interconnection of the elements 30, a longitudinal slot is machined centrally through one of the elements 30, the slot passing from an outer face of the element into the circular void. The slot thus forms the parallel-sided opening of the groove 38, while the void forms the broader part.

The groove 42 in each side surface 40 of the rib 14 has a generally circular cross section and a relatively narrow opening, the openings facing away from one another. Each groove 42 is defined between curved recesses So in each edge portions of the elements 30.

The fabric of the membrane sections 10 are provided with a "Keder edge" where they are to be connected to a rib 14. The Keder edge (well known to those skilled in the art) comprises an elongate bead 52 of wire or plastics encapsulated in a length of fabric disposed along an edge of a section of fabric material, this producing a bulbous edge portion, securely attached to the fabric. With reference to FIG. 7, each of the membrane sections 10 is attached to a rib 14 by sliding its Keder edge into one of the grooves 42 in the side surface 40. Similarly, each of the connecting elements 18 of the web 16 are retained in by sliding its bulbous end portion 54 into the groove 38 in the inner surface 36 of the groove.

Clearly, the grooves 38, 42, the Keder edge 52 and the connecting elements 18 must all be shaped and dimensioned such that the fabric components 10, 16 may slide longitudinally of the rib 16 but cannot be pulled away from it.

It would be possible, within the invention, for each rib 14 to be formed as a single continuous component. However, in order that a shelter embodying the invention may be readily folded for storage or carriage, the ribs 14 may be segmented into shorter lengths.

Figure 8:
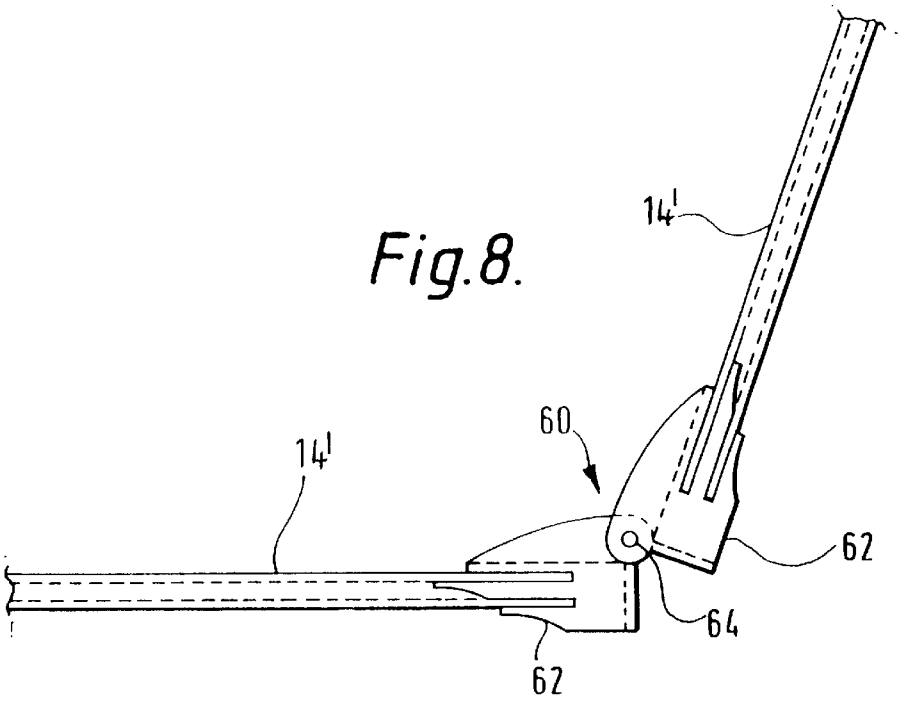
FIGS. 8 and 9 are side views of a portion of the rib of FIG. 6 at which adjacent sections are interconnected by a hinge, the figures showing, respectively, the rib partly folded and in use.
Figure 9:
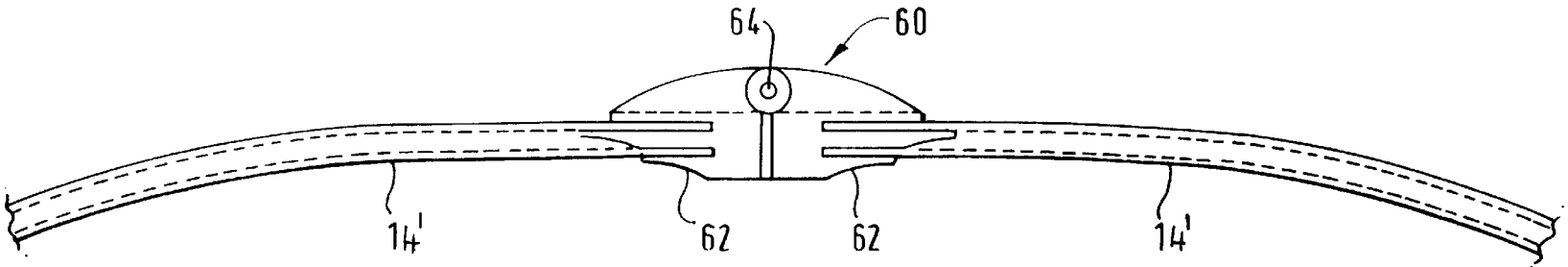

In this embodiment, segmentation of the ribs 14 is achieved, as illustrated in FIGS. 8 and 9, by the provision of hinges 60 to interconnect segments 16' of the rib 14. The hinges 60 allow the rib 14 and its associated web 16 and outer membrane components 10 to fold in a direction opposite to the curve of the truss 12 (as shown in FIG. 8), but which resist folding movement in the opposite direction (as shown in FIG. 9).

Figure 10:
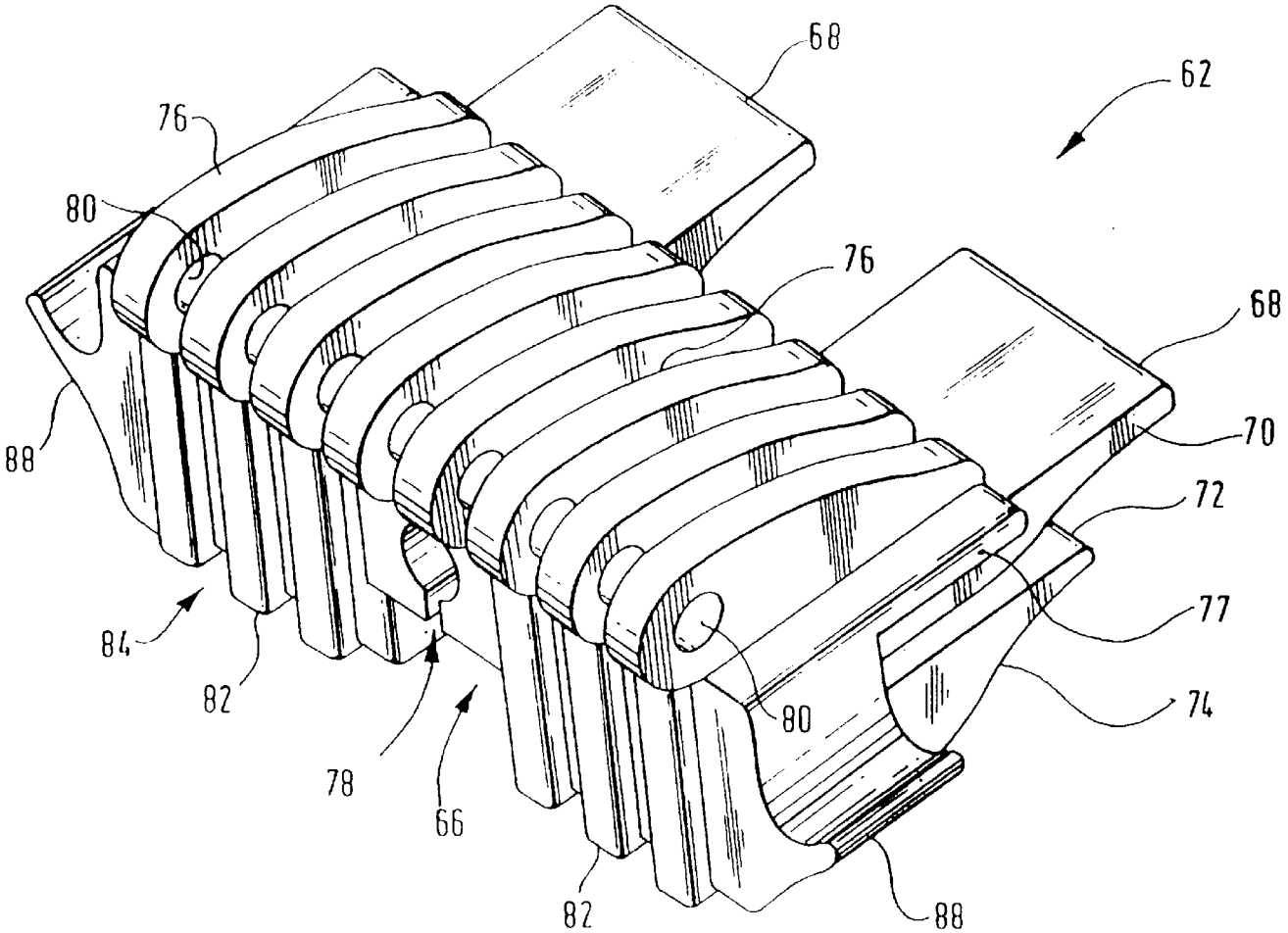
FIG. 10 shows, in greater detail, a leaf of the hinge of FIGS. 8 and 9.

Such a hinge, in the present embodiment, comprises two identical leaf components 62 (see FIG. 10), each being an injection moulding of glass reinforced nylon, interconnected by a hinge pin 64.

Each leaf 62 has a core portion 66 from which extends a pair of projecting spigots 68 of generally rectangular section, the disposition and dimension of each spigot 68 being (at least in a region proximal to the core portion 66) selected such that it is a tight fit within a respective one of the rectangular voids 44 within the rib 14. An end portion 70 of each spigot 68 is tapered to ease insertion of it into the void 44. However, it is beneficial if the taper is restricted to the surface of the spigot which will abut the inner surface of the void 44, the other surface being flat to ensure maximum contact area between the spigot 68 and the material of the rib 14.

A pair of inner abutment plates 72 extend from the core portion 66, each plate being disposed parallel to and spaced from a respective spigot 68, the spacing being such that the plates 72 bear upon the inner surface of the rib 14 when the spigots are inserted into the voids 44. The plates 72 are both supported against flexure away from the spigots 68 by a plurality of buttressing ribs 74 which extend from the core portion 66 to the inner surfaces of the plates 72, their end portions remote form the core portion 66 tapering towards the plates 72.

A second plate member 77 is disposed on the outermost surface of the core portion 66, the second plate member 77 extending to overlie the outer surface 34 of a rib 14 to which the leaf 62 is attached. A plurality of regularly spaced buttressing ribs 76 project from the plate member 68, each rib extending across the plate member 77 to project from the core portion 66 away from the rib 14, the end portions of the ribs 76 remote from the core portion 66 tapering towards the plate member 77. The spacing between adjacent ribs 76 corresponds closely to their thickness. Each rib 76 has a transverse through-hole 80, the holes 80 being in alignment to form a circular through bore. The centre of each hole 80 is substantially in alignment with a forward abutment surface of the core portion 66, the abutment surface being disposed normal to the plane of the spigots 68, inwardly of them.

The core portion 66 has centrally disposed a throughway 78 of shape and size closely corresponding to the groove 38 in the inner surface of the rib 14 in order that an attachment element 18 can slide uninterruptedly from the rib 14 through the leaves 62 of the hinge 60. Additionally, its abutment surface carries a plurality of regularly-spaced projecting ribs 82 and grooves 84.

A complete hinge 60 comprises two leaves 62. The leaves 62 are placed together with the projecting ribs 82 of one entering the grooves 84 of the other. Additionally, the ribs 76 of one are interdigitated with the ribs 76 of the other, such that the holes 80 of both are in alignment. The hinge pin 64 is then inserted through the holes 80 (in which it is a tight sliding fit) to interconnect the leaves 62.

It will thus be seen that the hinge 60 permits hinging movement in the direction shown in FIG. 8, but interengagement of the abutment surfaces resist movement in the other direction. Additionally, in the disposition shown in FIG. 10 the interlocking ribs 82 and grooves 84 give the hinge joint high shear and sideways stiffness. The multiple ribs 76 reduce shear stress on the hinge pin 64. This allows the diameter of the hinge pin to be minimised, thus reducing the overall depth of the hinge 60.

For the purposes of the present invention, a traditional spigot joint is likely to cause areas of localised stress on the rib which may result in the fibres within the rib splitting. In the above-described hinge, the buttressing ribs 74, 76 allow greater flexing of their respective plates 72, 77 in order that the components of the hinge bend evenly into the curve of the rib 14. This reduces the step change in the force applied to the rib 14 by the plates 72, 77, so reducing the risk of the rib splitting.

Each element 62 further carries, at opposite ends of its core portion 66, a pair of supports 88, each having a semi-cylindrical, outwardly directed grove. The Keder edge 52 of the membrane components 10 is supported within the groove during flexure of the hinge 60, so as to allow the rib 14 to fold without extending the web membrane.

A key property of the hinge 60 described above is that the plates 72 and the second plate member 77 encapsulate the rib 14 on its inner and outer surfaces 36, 34 in addition to providing connection to the rib through the spigots 68, so as to reduce the occurrence of localised stressed points within the rib 14. The above describe taper of the spigots 68 further decrease localised stress and facilitates curving of the rib 14 close to the hinge joint, the spigots 68 themselves having a suitable degree of flexibility.

As an alternative to a hinge mechanism, spigotted or other rigid but demountable joints may be used in order to provide a segmented rib 14 to facilitate folding of it.

Figure 1:
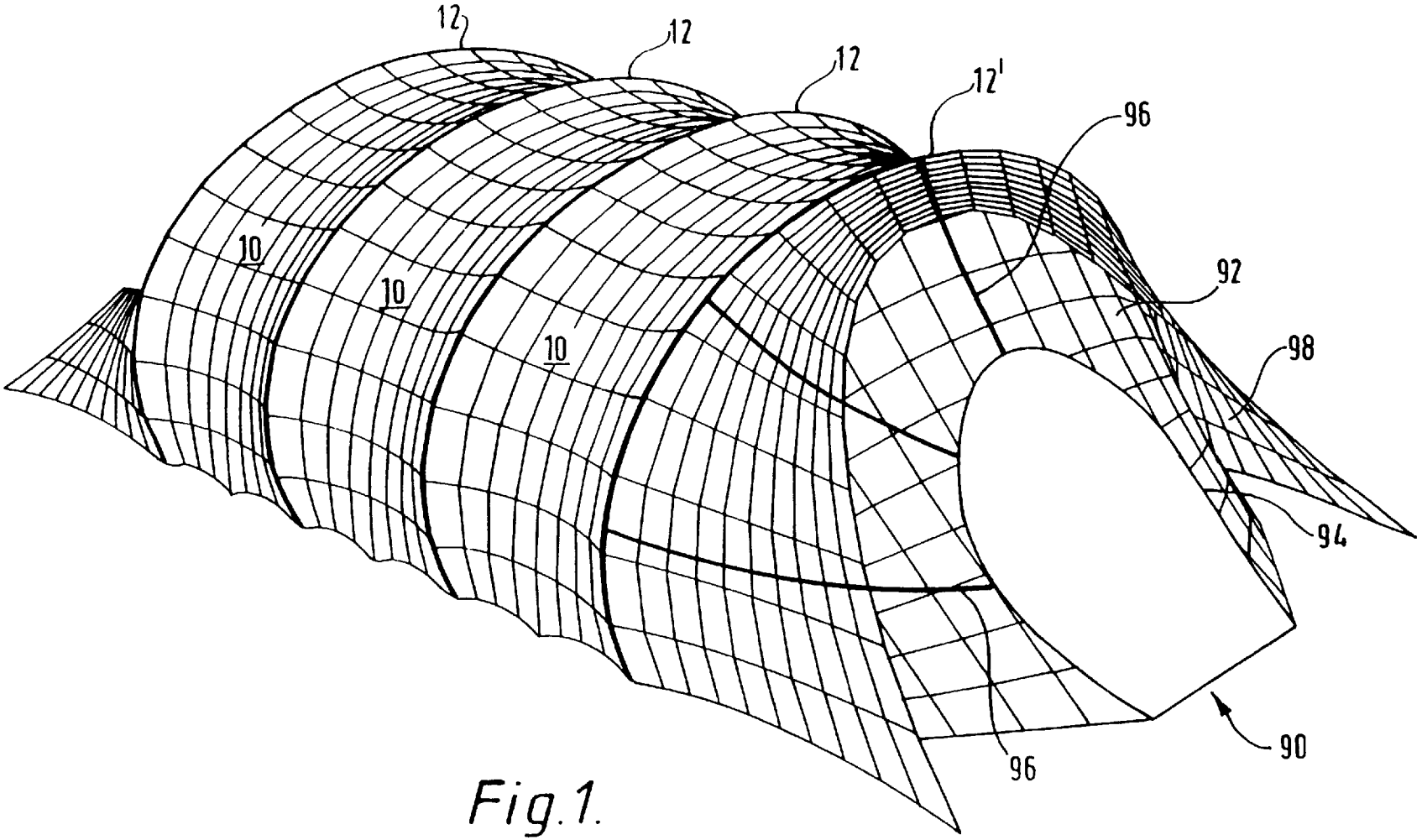
FIG. 1 is a line diagram of a shelter comprising a plurality of trusses embodying the invention.

The tent structure embodying the invention, as shown in FIG. 1 comprises a membrane formed from components 10 attached to trusses 12 in the manner described above. The main outer membrane is shaped into what is known as an anticlastic or double-curved shape between the trusses 12 where the surface curve is concave in one direction and convex in another, this producing a taut, substantially uniformly stressed surface.

As shown in FIG. 1, the trusses 12 are upright and parallel to one another, spaced along the length of the tent, and disposed transversely to a long axis of the tent. This arrangement has been found to permit convenient folding of the tent structure for travel or storage. The tent is constructed such that the sections of the membrane 10 between adjacent trusses 12 does not dip downwardly to an excessive extent in order that the membrane material does not unduly restrict folding of the ribs 14.

At one or both ends of the tent there is provided an entrance 90, comprising an openable end wall 92 formed of fabric extending generally downwardly from an end truss 12'. Within the end wall 92 there is an opening 94, optionally provided with a removable closure panel. The end wall extends axially a short distance from the end rib 12' to apply axial tension to it so as to support the tent in an axial direction. A plurality of releasable fasteners, such as zip fasteners 96, extend radially from the opening 94 to facilitate folding of the structure A cowl panel 98 also extends axially from the end truss 12', as illustrated in FIG. 1. This provides further axial support for the tent, with the advantage that the end wall 92 can be removed altogether should a particularly large opening be required.

One alternative form of construction has the trusses 12 disposed in pairs, the ends of the trusses 12 in a pair being close to one another, the trusses 12 diverging away from their ends. Other constructions embodying the invention might employ radially disposed trusses 12 to form a dome.

The truss 12 is provided with tensioning means to assist in obtaining sufficient tension in the web 16. Suitable means include a pair of winches 86, each being secured to the rib 16 close to respective ends thereof, as shown in FIG. 2. However, many alternatives are possible, including, for example, a ratchet buckle, or an over-centre lever secured to the rib 14 close to at least one end of it, and being suitably connected to the web 16. The winches 86 each control a length of cable which is connected for pulling on a respective laminar plate fixed to an end region of the web. In cases where the rib is not intended to be folded (and is thus not provided with hinges) such a tensioning system may not be required.

When the rib 14 is straightened out prior to being folded, it can be seen that the length of the rib 14 is greater than the length of the web 16 (most particularly at its inner edge 28). The connection between the web 16 and the rib 14 must therefore allow relative sliding movement of the web 16 along the rib 14. The web 16 is highly preferably free to form convolutions along the rib 14. The use of discrete connecting elements 18 running in a groove 38 incorporated into the rib 14 is therefore greatly preferred to a Keder edge or a roped edge which will slide in the groove but which cannot fold.

To prevent the connecting elements 18 from becoming detached from the rib 14 when it is folded, the connecting elements 18 must be gathered together into a relatively short length on a part of the rib segments 14' intermediate the ends thereof. To assist in this means for holding the folded web 16, such as clamps which can be secured to the rib 14 or pins insertable through the rib 14, may be provided.

The invention may be used in all recognised arched truss applications such as military, civilian and commercial shelters, tents and marquees, as well as in other temporary and ornamental structures, such as bridges.

As a comparison, a truss comprising an outer member on a flat plate web of shape similar to a truss embodying the invention would, under external loads such as wind pressure or snow, be subject to varying bending loads along its length. These bending loads would put parts of the truss into compression and parts into tension. In the present invention, it is clear that substantially only the rib can resist compression forces while substantially only the web (and, where provided, its tensile) edge can resist tension forces. By adopting a form similar to that one in FIG. 2 wherein the two extreme ends of the truss are urged apart, the rib is axially compressed and the web is put into tension. External applied loads, such as might be caused by wind or snow, will produce bending loads in the truss. These bending loads will induce compression forces in some parts and tension forces in others. Compression forces induced in the web will merely reduce the magnitude of the tension preset in it. If there were no preinduced tension the edge would be under compression which it would clearly be unable to resist.

In the above-described arrangement, a problem can occur when the rib 14 is folded. It will be seen that the pivotal axis of the hinge 60 lies offset from the plane of the rib 14. A result of this is that the web 16 must slide within the rib 14 as the rib 14 is folded and unfolded. This can, in some circumstances, result in the material of web 16 or of the membrane sections 10 becoming trapped in the hinge 60. In extreme cases, this could result in stress or tearing of the trapped material.

Figure 11:
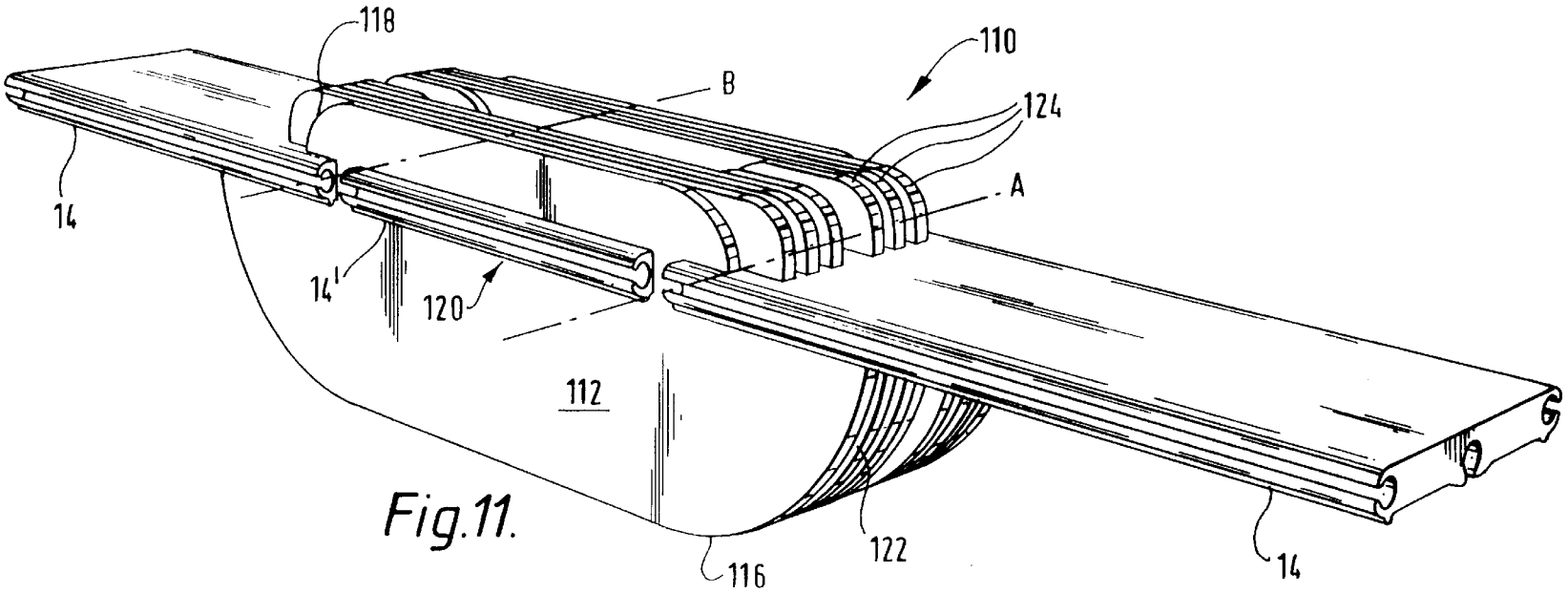
FIGS. 11 and 12 show a first alternative hinge for use in a truss of the present invention.
Figure 12:
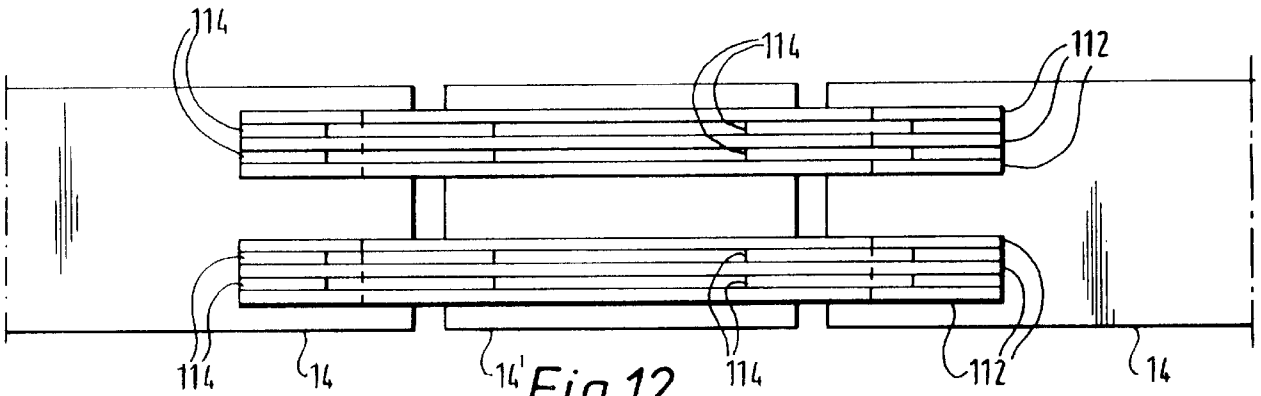

With reference to FIGS. 11 and 12, a first alternative hinge 110 is shown, which avoids this problem. The hinge 110 comprises two pivotal axes A, B spaced apart along the length of the rib 14. The hinge 110 comprises a plurality of laminar elements 112,114 of alternate first and second types. The first type of element 112 has an inner portion which has a generally D-shaped body portion 116 from which projects, within the plane of the element, a smaller D-shaped part 118, the body portion 116 and D-shaped projecting part 118 meeting one another at a straight line. Within the smaller projecting part 118, a pair of through holes are formed. A straight edge of the body portion 116 extends beyond the projecting part 118. The relative positions of the straight edge and the holes is such that a length of rib 14 resting in contact with the straight edge will be disposed such that its median plane is coplanar with the axes of the holes. A slot 120 extends through the element 112. The slot 120 is of a thickness to receive a length of rib 14' as a close fit. The median plane of such a length of rib 14' is coplanar with the axes of the holes.

Two of the second type of element 114 are disposed between each pair of the first type of element 112. Each element of the second type comprises a semi-circular body portion 122 with a hook-like projection 124. The projection has a slot extending into it, parallel to the straight edge of the semi-circular body portion 122, the slot being of a width such that it can receive an end portion of rib 14 as a close sliding fit. Adjacent the slot is a through hole, disposed such that the median plane of a rib disposed in the slot is coplanar with the axis of the hole.

The hinge 110 is assembled in from two groups of elements 112,114. A pair of metal pins pass through the holes in the elements to allow pivoting movement between them. End portions of rib element 14 are inserted into the slots in the elements of the second type, so as to lie in contact with the straight edges of all of the element. A length of rib 14' is inserted through the slots 120 in the elements of the first type 112. The lengths of rib 14 can then pivot, together with the elements of the second type 114, away from the straight edges. Pivotal movement in the opposite direction is resisted by the straight edges. Minimal disruption to the web occurs because it is coincident with the pivotal axis, and because only very short lengths of it are unsupported by adjacent rib 14,14'.

Figure 13:
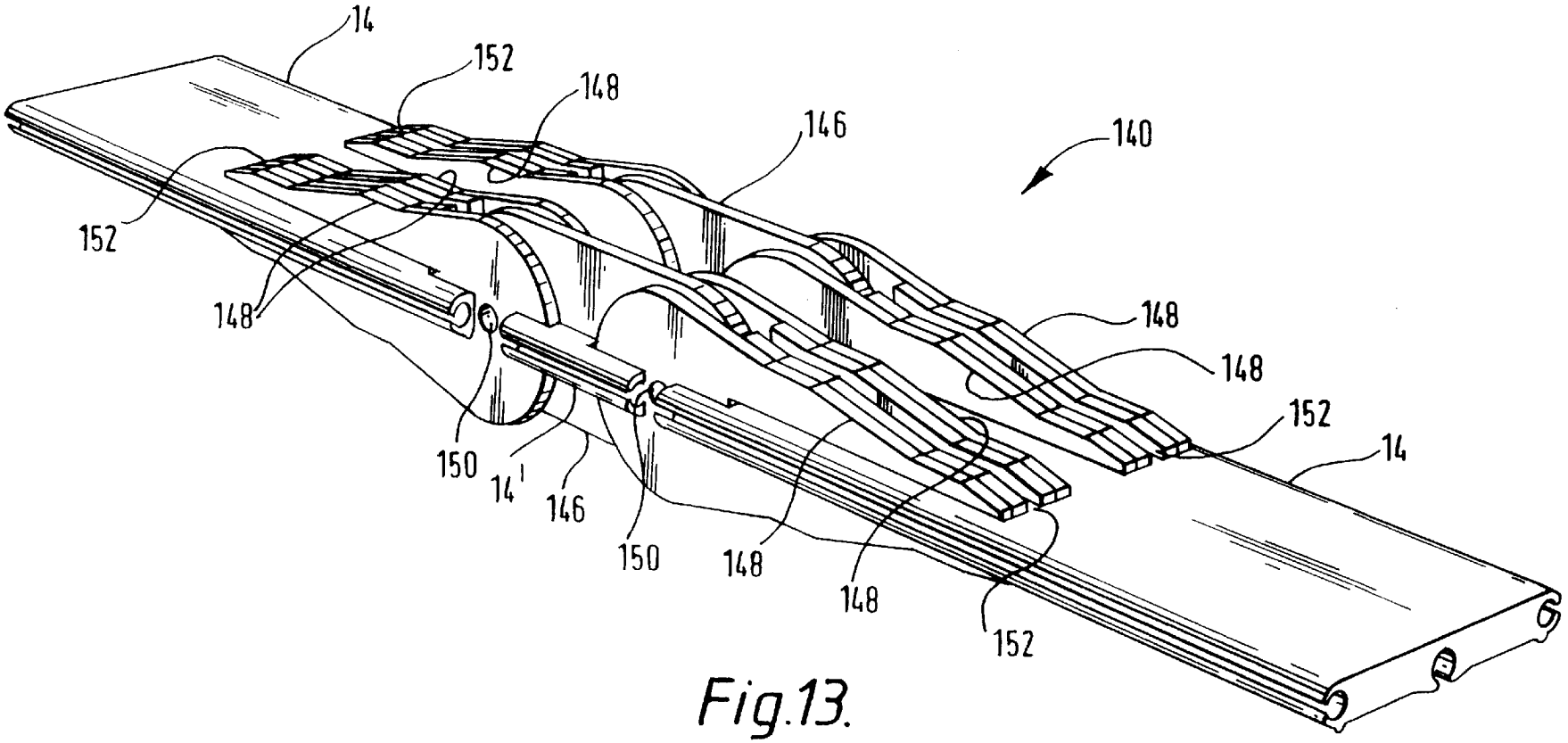
FIG. 13 shows a second alternative hinge for use in a truss of the present invention.

With reference to FIG. 13, a further type of hinge 140 comprises various types of laminar element. These are arranged in two identical groups.

Each group comprises a central linking element 146. The linking element 146 has straight sides extending between rounded ends. It also has a pair of spaced through holes. A fulcrum pin extends through the through holes to carry a pair of rib-engaging assemblies of each group for pivotal movement. A length of rib 14' is carried on the linking element 146 to support the adjacent web.

Each rib engaging assembly comprises a pair of outer components 148 having an elongate slot into which an end portion of a rib 14 is inserted. Each outer component 148 has a body part, in which is formed a through hole 150 for pivotal engagement on one of the fulcrum pins. The hole 150 is disposed in the median plane of the rib 14. Thus, flexing of the hinge is permitted in a direction upwardly in FIG. 13.

Spacer members 152 are disposed between the outer components 148. The spacer elements have abutment surfaces which are directed towards similar surfaces of the other rib-engaging assembly. These abutment surfaces engage a block integral with or carried on the linking element 146, so inhibiting pivotal movement in a downward direction, as shown in FIG. 13.

The pivotal axes (X,Y are defined by the positions of the holes are arranged to pass through the median plane of the Keder edge of the web 10. This ensures that the web does not slide with respect to the rib 14 during folding or unfolding of the hinge 140.

A particular advantage of the hinge 140 of FIG. 13 is that it allows the edges of the membrane sections 10 to be supported along most of their lengths.

Figure 14:
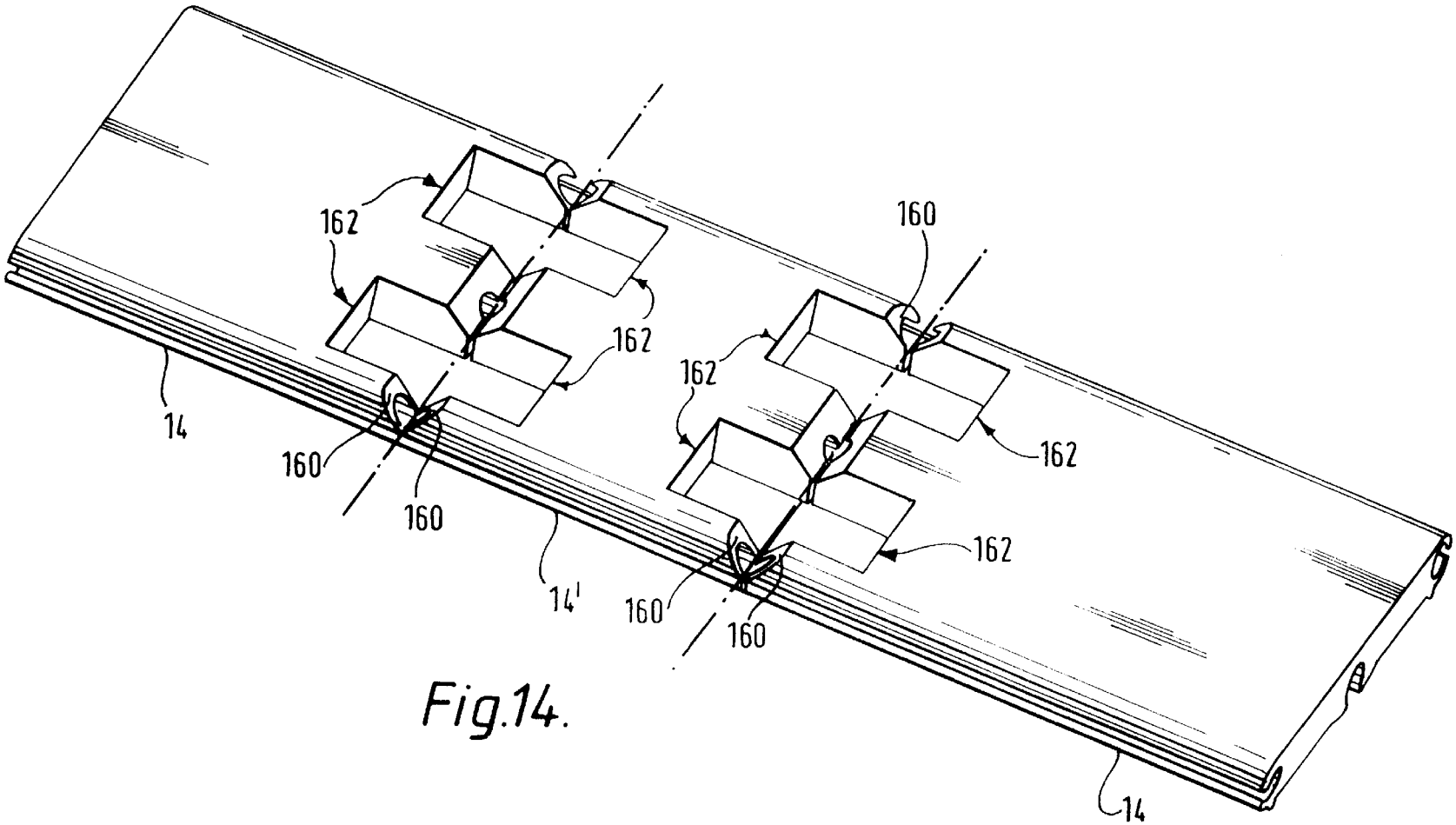
FIG. 14 shows the disposition of rib elements within the hinge of FIG. 13.

FIG. 14 shows the relative positions of the rib segments 14 when fixed in the hinge 140 of FIG. 13. End surfaces 160 of each rib segment 14 and the length of rib 14' are chamfered to permit the rib segments 14 to pivot relative to one another, while allowing them to approach one another as closely as possible. Slots 162 extend longitudinally into end portions of the rib segments 14 and the length of rib 14' into which components of the hinge 14 can enter. This allows the rib segments 14 to approach more closely the length of rib 14'.

The arrangement of the hinge 140, as a whole, is such that only a minimum length of the keder edge remains unsupported by immediately adjacent rib 14,14'.

What is claimed is:

1. A structural supporting truss comprising an elongate rib of resilient material and a web of fabric material; wherein the rib is connected to the web; and the rib, in use as an assembled truss, is resiliently deformed to adopt a curved shape, the web extending radially inwardly of the rib along a length of the rib, such that the web acts in tension to retain the rib in the curved shape; and wherein the web comprises a plurality of interconnected fabric panels; and the shape of the panels is such that, when interconnected and laid flat, the web adopts approximately the curved shape of the assembled truss.

2. A truss according to claim 1 in which the fabric material is capable of resisting shear stress.

3. A truss according to claim 1 or claim 2 in which the material of the web is a bias cut woven material.

4. A truss according to claim 3 in which both warp and fill fibres of the material of the web are disposed at an angle of approximately 45° to the rib.

5. A truss according to claim 1 in which the web is secured to the rib such as it may slide along the rib.

6. A truss according to claim 1 in which the web is secured to the rib at spaced intervals along the rib.

7. A truss according to claim 6 in which the web is secured to the rib by discrete attachment elements spaced along its length.

8. A truss according to claim 7 in which the attachment elements comprise projections of the web, each projection carrying a formation for retention in a cooperating formation of the rib.

9. A truss according to claim 8 in which the formation on the attachment element comprises a bulbous portion thereof and the formation on the rib comprises a groove of cross section to slidingly receive said bulbous portions.

10. A truss according to claim 1 in which a portion of the web remote from the rib is reinforced so as to resist tensile forces.

11. A truss according to claim 10 in which the reinforcement comprises a length of webbing secured to the web.

12. A truss according to claim 11 in which the webbing surrounds a radially inner edge portion of the web.

13. A truss according to claim 11 in which a length of cord or wire is encapsulated within the webbing.

14. A truss according to claim 1 in which each fabric panel is formed of woven fabric material, the warp and fill fibres of the material being disposed at an angle of approximately 45° to the rib.

15. A truss according to claim 1 in which attachment elements for securing the web to the rib are provided at interconnection regions between adjacent panels.

16. A truss according to claim 1 in which the rib comprises an extrusion or a pultrusion of fibre reinforced plastics.

17. A truss according to claim 1 in which the rib comprises a plurality of sections interconnected by hinges which permit the truss to be folded for storage in a direction opposite to the curve of the rib in use.

18. A truss according to claim 17 in which each of the hinges comprises two identical plastic mouldings interconnected by a hinge pin.

19. A truss according to claim 18 in which each of the hinges has a pivotal axis which is coincident with a median plane of the rib sections which it is interconnecting.

20. A truss according to claim 19 in which each hinge has two special pivotal axes, each of which is coincident with a median plane of a proximal rib section.

21. A truss according to claim 1 in which the rib comprises a plurality of interconnected sections which can be disconnected from one another.

22. A truss according to claim 1 comprising tensioning means for applying tension to the web.

23. A truss according to claim 22 in which the tensioning means comprises at least one of a buckle or a winch.

24. A shelter structure comprising a frame including at least one truss according to claim 1 and an outer membrane supported by the frame.

25. A shelter structure according to claim 24 in which the outer membrane comprises a plurality of sections each secured to at least one truss.

26. A shelter structure according to claim 25 in which each section is provided with a Keder edge by which it can be secured within a groove of the rib of a truss to which it is to be secured.

27. A shelter structure according to claim 24 in which the frame comprises a plurality of pairs of trusses, the ends of the tusses of each pair diverging from common supporting feet.

* * * * *

UNITED STATES PATENT AND TRADEMARK OFFICE

CERTIFICATE OF CORRECTION

PATENT NO. : 6,082,385

DATED : July 4, 2000

INVENTOR(S) : N.K. Burford et al.

It is certified that error appears in the above-identified patent and that said Letters Patent is hereby corrected as shown below:

| COLUMN | LINE | |
|---|---|---|
| [54]<br>Pg. 1, col. 1 | Inventors | Broughty Ferry" should read --Dundee--; "Tealing" should read --Dundee--; and "New Milton" should read --Hampshire-- |
| [56]<br>Pg. 1, col. 2 | Refs. Cited U.S. Pats., Item 2 | "Russel" should read --Russel et al.-- |
| [56]<br>Pg. 1, col. 2 | Refs. Cited U.S. Pats., Item 3 | "Tury" should read --Tury et al.-- |

UNITED STATES PATENT AND TRADEMARK OFFICE

CERTIFICATE OF CORRECTION

PATENT NO. : 6,082,385

DATED : July 4, 2000

INVENTOR(S) : N.K. Burford et al.

It is certified that error appears in the above-identified patent and that said Letters Patent is hereby corrected as shown below:

| COLUMN | LINE | |
|---|---|---|
| [57] | Abstract | "of" should read —or-- |
| Pg. 1, col. 2 | 11 of text | |

Signed and Sealed this

Seventeenth Day of April, 2001

*Attest:*

Nicholas P. Godici

NICHOLAS P. GODICI

*Attesting Officer*

*Acting Director of the United States Patent and Trademark Office*